United States Patent [19]

Marquaire et al.

[11] 3,983,937

[45] Oct. 5, 1976

[54] METHOD OF CONNECTION OF AN UNDERSEA WELL TO A FLEXIBLE OUTFLOW PIPE

[75] Inventors: Roger Marie Andre Marquaire, La Celle St Cloud; Michel Georges August Curtis, Lyon, both of France; Robert Edouard Schappel, London, England

[73] Assignee: Subsea Equipment Associates Limited, Hamilton, Bermuda

[22] Filed: Apr. 7, 1975

[21] Appl. No.: 565,969

[30] Foreign Application Priority Data

Apr. 5, 1974 France ..... 74.12173

[52] U.S. Cl. ..... 166/.5; 61/69 A

[51] Int. Cl.² ..... E21B 7/12

[58] Field of Search ..... 166/.5, .6; 175/27; 61/46.5, 69 A

[56] References Cited

UNITED STATES PATENTS

| | | | |
|---|---|---|---|
| 3,211,223 | 10/1965 | Hoch | 166/.6 |
| 3,353,364 | 11/1967 | Blanding et al. | 166/.5 |
| 3,512,583 | 5/1970 | James | 166/.5 |
| 3,656,549 | 4/1972 | Holbert, Jr. et al. | 166/.5 |
| 3,846,992 | 11/1974 | Liautaud | 166/.6 |
| 3,855,806 | 12/1974 | Le Therisien | 166/.5 |

*Primary Examiner*—James A. Leppink

*Attorney, Agent, or Firm*—Sughrue, Rothwell, Mion, Zinn and Macpeak

[57] ABSTRACT

In the connection of a flexible outflow pipe to a submerged well head situated at a depth greater than that which can be reached by a diver, the pipe is connected to a bearing structure for bearing on and connection to the well head and on which a diving bell bears, the bell being made fast to the bearing structure and housing a sub-assembly for connection to the well head, the assembly of bell, bearing structure and attached pipe is lowered onto the well head and automatically connected thereto, thereafter a crew is lowered in a crew carnes to the bell and the crew effects connection of the sub-assembly to the well head and the pipe connector to the sub-assembly while in the bell.

10 Claims, 5 Drawing Figures

METHOD OF CONNECTION OF AN UNDERSEA WELL TO A FLEXIBLE OUTFLOW PIPE

The invention relates to the connection of an undersea well to a flexible outflow pipe, particularly when the well is at a depth greater than that which can be reached by a diver.

The present methods for connection in water which is not very deep are derived from conventional methods of connection at the surface. In view of the difficulties due to the high pressures existing in deep water, known methods for connecting outflow pipes without the intervention of divers have to comprise a number of remotely controlled operations requiring complicated apparatus and tricky manipulations which render the connection of the pipe a long and costly operation.

According to the present invention there is provided a method of connection of a flexible outflow pipe to a submerged well at a depth which may be greater than that which can be reached by a diver, characterised in that the method comprises one end of said outflow pipe at the surface to a pipe connector passing through and carried by a bearing structure, said bearing structure comprising connector means for watertight attachment of said structure to the well casing, fixing said bearing structure to a diving-bell so that said diving-bell bears by the base on said bearing structure, said diving-bell containing a sub-assembly bearing at least one master-valve and means of connection to the well lining, lowering the assembly of said bell and bearing structure onto said well until said connector means is connected to said well casing so ensuring watertightness of said bell bearing on said bearing structure, joining said sub-assembly said well lining and connecting said sub-assembly to said pipe connector from the interior of said bell and bringing said bell back to the surface.

In a preferred method of connection of a well to a flexible outflow pipe, having equipped the well head with a male connector which is watertight to the casing, one proceeds with the following stages:

a. at the surface one of the ends of the pipe is connected to a pipe connector passing through a bearing structure which is provided in its central zone with a female connector for fixng it in a watertight fashion to the said male connector on the well head and provided at its periphery an annular bearing surface on which a diving-bell is intended to bear, b. at least a first sub-assembly forming a portion of the well head and capable of being connected directly to the head of the lining is fixed inside the bell, this sub-assembly containing at least one master valve for controlling the flow of the crude produced by the well and at least one tapping for leading the crude to the pipe connector in the structure, c. the bell is made to bear on the surface of the bearing structure and fixed to said structure, d. the bell is then suspended by means of any guide and remote-control device from the end of a riser which is lowered at the same time as the outflow pipe, e. when the assembly of bell and bearing structure has been lowered onto the well head, female connector is locked in a watertight and automatic manner onto the male connector, f. atmospheric pressure is re-established inside the bell, g. the outflow pipe is placed in position, h. a crew is lowered by an auxiliary chamber and enters the bell, i. the sub-assembly is connected by the crew to the well head and the tapping is connected to the pipe connector, j. finally the crew is brought back to the surface by the auxiliary chamber and the bell is raised.

It will be observed that the above preferred method enables all the tricky problems of connection of the outflow pipe in deep water to be solved without having to multiply the lowering of more-or-less complicated remotely-controlled devices. Further, this method enables such a connection to be carried out in complete safety. That is, the connection of the outflow pipe to the pipe connector on the bearing structure being carried out at the surface, one can easily employ any means of watertight connection between the pipe and its connection for withstanding any external or internal pressure whatever. In particular the end of the pipe may be welded to the connector and the weld checked at the surface. Similarly the connection of the tap-off pipework proceeding from the sub-assembly of the well head, which is installed on the well head at atmospheric pressure inside the bell by a crew, presents no difficulty inasmuch as all the heavy elements, i.e. the bearing structure and well head sub-assembly, are mounted and locked either automatically, as far as the bearing structure is concerned, or by means of a handling device with which the bell is equipped, with possibly an automatic guide-means, as far as the well head sub-assembly is concerned.

It will be observed also that the connections are carried out without being subjected to pounding effects due to motion of the surface vessel because the connection of the pipe to the pipe connector on the bearing structure has already been carried out on the surface and no movement occurs as soon as the bearing structure is locked by its female connector on the male connector.

Advantageously there is carried out in one and the same operation the connection of an electric cable for the various remote-control stations intended for checking the production of the well. The cable is connected at the surface to a second watertight electric connection passing through the bearing structure, the electrical connection of the said cable to the sub-assembly being carried out at the same time as the connection of the tap-off pipework to the outflow pipe connector.

Besides the immediate advantage secured by the lowering and simultaneous placing of the outflow pipe and the electric cable it can be seen that this method enables satisfactory operation of the production well head sub-assembly to be checked by the crew who connect the tap-off pipe to the outflow pipe connector and at the same time connect the sub-assembly to the electric connector.

Thus a single descent of a bell carrying a bearing structure and a sub-assembly containing at least one master-valve and connectors for electrical connections and an outflow pipe and an electric cable already connected to the bearing structure is sufficient to enable a production well to be put into operation.

The invention will be more fully understood from the following description of an embodiment thereof, given by way of example only, with reference to the accompanying drawing.

Figure 1:
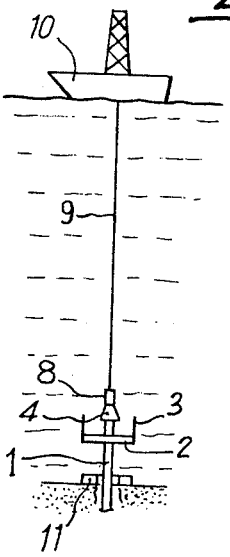
FIG. 1 is a diagrammatic view of a surface vessel and the base structure of a well head during the course of its placement.

In FIG. 1 the placing of the last elements of the well head mounted on the casing 1 is illustrated, the element 2 is a conventional base structure provided with any suitable means of guidance, for example the columns 3. The male portion of a connector 4 is provided at the top end of the casing 1. This connector portion visible more clearly in FIG. 5, has the purpose of ensuring external watertightness of the well between the casing 1 and the lining 31, FIG. 2, and of serving as the seating for a female connector portion 6 fixed by its flange 7 to a bearing structure 18. The handling tool 8 (FIG. 1) fixed to the end of the riser 9 and engaging the connector portion 4 may be of any known type. The drilling vessel 10 is provided with the usual anchoring devices and any necessary anti-pounding devices. By way merely of indication a conventional temporary guide-base has been indicated at 11, which has been omitted from FIGS. 2 and 5.

Figure 2:
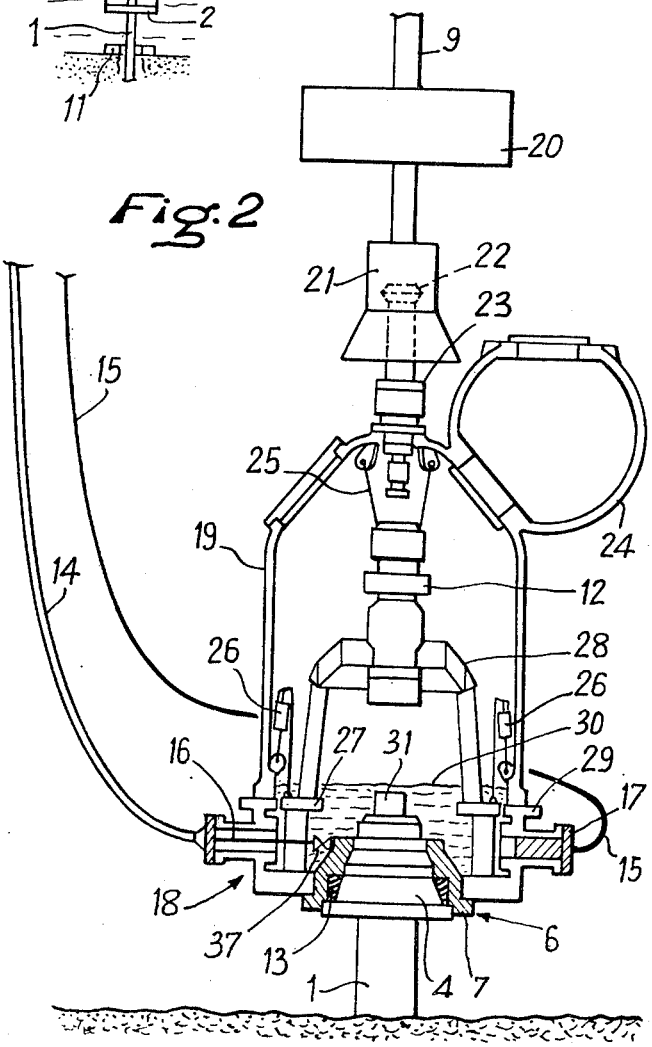
FIG. 2 is a diagrammatic view partially in section of a bell for lowering the structure for placing a well head sub-assembly and outflow pipe on the well head.

FIG. 2 shows the end of the riser 1 and its male connector 4 before the placing of a sub-assembly 12, comprising at least one master-valve enabling discharge of crude to be controlled, and the female connector portion 6 has been coupled to the male connector portion 4. Watertightness of the joint between these portions is ensured by a flexible seal 13.

One of the ends of a flexible outflow pipe 14 and of an electric cable 15 are connected at the surface to connectors 16 and 17 of the bearing or placement structure 18. The pipe 14 may be connected to connector 16 by welding. The assembly of pipe 14, cable 15 and bearing structure 18 is then lowered by means of the riser 9 and a bell 19.

For this purpose, there is fixed to the riser 9 a guide and remote control device 20 provided for example with sonar position finding devices and from which is suspended a tool 21 for handling the bell 19. This tool 21 caps the connection end 22 of the bell 19 and is used to control a device 23 controlling valves for putting the bell 19 under pressure or under decompression. The bell 19 includes an airlock 24 for access to its interior, handling devices 25 for holding and lowering the sub-assembly 12, an impact-damper device 26 bearing against a bearing surface 27 on the structure 18, and conventional safety devices which are not shown. The bearing surface 27 is also used to support a protective structure 28 with which it may be made fast, the protective structure 28 serving both to hold and guide the sub-assembly 12 during the course of its placing but also to protect the sub-assembly 12 after withdrawal of the bell. The protective structure includes a position-finding device which is adjusted as a function of the exact orientation of the sub-assembly 12 for use when subsequently mounting other sub-assemblies on the sub-assembly 12 to complete the well head. As this position-finding device may be of any kind and may be simple index it has not been shown.

The bell 19 rests on an annular bearing surface 29 of the bearing structure 18 and may be of a type different from that shown. Equally the guide device 20, which ensures satisfactory presentation of the bell 19 on the axis of the well, the device 21 enabling handling of the bell and transmission of commands thereto, and connector devices 16 and 17 may be of any conventional type. It is for this reason that these components have not been described in detail.

During the course of the lowering of the bell 19 a certain buoyancy is preserved by operation of the valves of the device 23 so as to maintain the level 30 of the water in the bell in the vicinity of the surface 29 on which the bell 19 bears. In this way the guide device 20 can easily be employed, the device 20 being intended to ensure correct presentation of the assembly and particularly the female connector portion 6 to the male connector portion 4. It will be understood that the flexible outflow pipe 14 and the cable 15 are paid out from the surface vessel 10 as the assembly is lowered by a conventional control means. Thus the general orientation of the structure 18 is determined by the guide device 20 and the locating of the female connector portion 6 on the male connector portion 4 is carried out without shock because of the buoyancy given to the bell 19 and of the flexible seal 13 between the connector portions 4 and 6.

Figure 3:
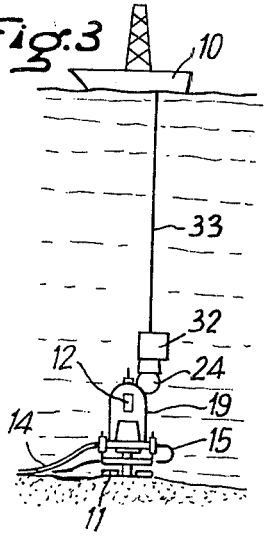
FIG. 3 is a diagrammatic view of a surface vessel and a chamber for transfer of a crew to the bell.

As soon as the connector portions 4 and 6 have been assembled together the decompression valves 23 are operated to decompress the bell to enable subsequent introduction of a crew. This manoeuvre has the effect of forcing the bell 19 against the surface 29 and crushing the seal 13 between the male and female connector portions 4 and 6. Under these conditions the riser 9 with its guide device 20 and handlng device 21 may be brought back to the surface and the other ends of the outflow pipe 14 and the cable 15 connected as required. After the placing of the assembly transfer chamber 32, FIG. 3, conveying a crew intended to control the placing of the sub-assembly 12 on the lining 31 is lowered from the surface vessel 10. In the example under consideration the transfer chamber 32, whilst being connected by a cable 33 to the vessel 10, has its own means of orientation and displacement in order to place itself on the airlock 24 of the bell 19.

Figure 5:
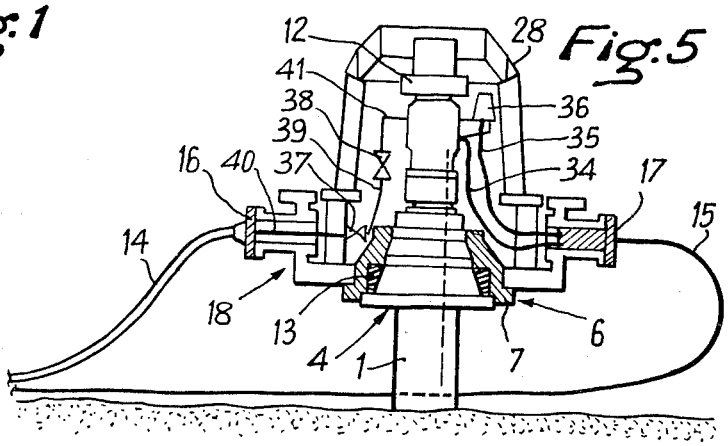
FIG. 5 is a diagrammatic view of the well head after placement of the sub-assembly and the outflow pipe.

Once in the bell the crew then proceeds to carry out the following operations:

Checking of the whole of the mechanisms employed;

Unlocking, lowering and installation of the sub-assembly 12, FIGS. 2 and 5, whilst orientating it angularly for connection of the pipework contained in the lining 31;

Establishment of the electrical connections joining the connector 17, already connected to the outer cable 15, to control circuits 34 of the sub-assembly 12 and to a distribution circuit 35 connected to an electrical connector 36;

Connection of auxiliary valves 37 and 38 by pipework 39, the valve 37 ensuring closure of pipework 40 from the connector 16 and the valve 38 ensuring closure of the tapping 41 leading to the master valve of the sub-assembly 12.

Registration the position of the sub-assembly 12 with respect to the structure 28 with a view to subsequent mounting of a second sub-assembly controlling the sub-assembly 12.

Checking of the electrical circuits 34 and 36 and the connection of the pipe 14 to the master-valve of the sub-assembly 12.

Figure 4:
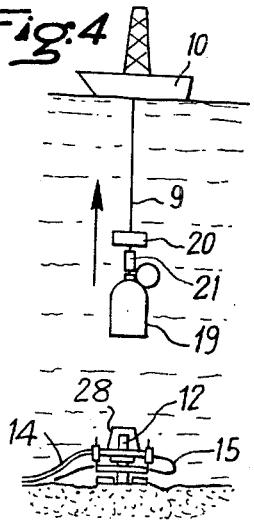
FIG. 4 is a diagrammatic view illustrating the raising of the bell alone.

After testing the outflow pipe 14 so connected the crew returns to the surface and the bell 19 can then be withdrawn by means of the riser 9 and the guide device 20 and handling device 21, as shown in FIG. 4.

The well is now ready to be operated.

Numerous variants of the above described method may be conceived dependent on the particular means provided. For example, the bell may include an auxiliary chamber rendering unnecessary the lowering of an auxiliary chamber. Similarly an auxiliary chamber might be employed, which is not connected to the surface vessel. As to the male connector it may be simplified or even omitted depending on the particular arrangement adopted for the heads of the casing and lining, only the female connector portion 6 provided with means of fluid tightness and locking onto the casing and lining heads being retained on the bearing structure 18.

What is claimed is:

1. A method of connection of a flexible outflow pipe to a submerged well at a depth which may be greater than that which can be reached by a diver the method comprising connecting one end of said outflow pipe at the surface to a pipe connector passing through and carried by a bearing structure, said bearing structure comprising connector means for watertight attachment of said structure to the well casing, fixing said bearing structure to a diving-bell so that said diving bell bears by its base on said bearing structure, said diving bell containing a sub-assembly bearing at least one master valve and means of connection to the well lining, lowering the assembly of said bell and bearing structure onto said well until said connector means is connected to said well casing so ensuring watertightness of said bell bearing on said bearing structure, joining said sub-assembly to said well lining and connecting said sub-assembly to said pipe connector from the interior of said bell and bringing said bell back to the surface.

2. A method as claimed in claim 1, wherein one end of an electric cable is connected, at the surface and externally with respect to said bearing structure, to an electrical connector passing through said structure and said electrical connector is connected to said sub-assembly when said pipe connector is connected to said sub-assembly.

3. A method as claimed in claim 1 wherein said connector means also acts as an impact damper.

4. A method as claimed in claim 1 where said sub-assembly is assembled with a protective structure by which it is fixed to said bearing structure and a damper device is interposed between said bearing structure and said bell.

5. A method as claimed in claim 1 wherein said end of said flexible outflow pipe is welded at the surface to said pipe connector.

6. A method as claimed in claim 2 wherein the assembly of said bell and said bearing structure is lowered by a riser from a drilling vessel, said riser including a guide device and a tool for handling said bell, a winch controls the paying out of said outflow pipe, and a winch controls the paying out of said electric cable, the pressure inside said bell is controlled to keep the pressure inside said bell is controlled to keep the level of the water therein at the level of said base of said bell, said pressure being brought back to atmospheric pressure as soon as said bearing structure is connected by said connector means to said well casing, and said vessel is displaced to place and attach the ends of said outflow pipe and said electric cable at the place selected.

7. A method as claimed in claim 6 wherein connection of said sub-assembly to said lining is preceeded by the lowering, by means of a transfer chamber, of a crew to said bell after retraction of said riser and placing of said outflow pipe and said electric cable, said crew being withdrawn by said transfer chamber after operation of the production circuit of said well has been checked.

8. A method as claimed in claim 2 wherein when said bearing structure has been connected to said well, a first electrical circuit is connected between said electrical connector and said sub-assembly, a second electrical circuit is connected between said sub-assembly and a free connector, an auxiliary valve is connected to an auxiliary valve connected to said pipe connector, and a guide mark on a protective structure for said sub-assembly is adjusted relative to said sub-assembly to indicate the orientation of said sub-assembly with respect to said protective structure.

9. A method as claimed in claim 1 wherein said connector means is a female connector and prior to lowering of said bell, a casing head is lowered onto said well casing which casing head includes a male connector intended to receive said female connector, said male connector ensuring watertightness between said lining and said casing.

10. A bearing structure for use in carrying out the method of claim 1 comprising a plane annular surface on which said bell is intended to bear and connected by a cylindrical surface to another annular surface, wherein said other annular surface includes a female connector member provided at its lower portion with a flexible seal means at least one connector fast with a flexible pipe passing through said cylindrical surface.

* * * * *

UNITED STATES PATENT AND TRADEMARK OFFICE

CERTIFICATE OF CORRECTION

PATENT NO. : 3,983,937

DATED : October 5, 1976

INVENTOR(S) : Roger Marie Andre Marquaire et al

It is certified that error appears in the above-identified patent and that said Letters Patent are hereby corrected as shown below:

Column 6, lines 12 and 13: delete "pressure inside said bell is controlled to keep the"

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*